US011581687B2

(12) United States Patent
Wang et al.

(10) Patent No.: US 11,581,687 B2
(45) Date of Patent: Feb. 14, 2023

(54) PCIE/SAS FEMALE ELECTRICAL CONNECTOR

(71) Applicant: Amphenol East Asia Electronic Technology (Shenzhen) Co., Ltd., Shenzhen (CN)

(72) Inventors: Xiang Wang, Shenzhen (CN); Yan-Bin Tan, Shenzhen (CN); Lei Liao, Shenzhen (CN); Wei Luo, Shenzhen (CN)

(73) Assignee: Amphenol East Asia Electronic Technology (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/204,484

(22) Filed: Mar. 17, 2021

(65) Prior Publication Data

US 2022/0302655 A1 Sep. 22, 2022

(51) Int. Cl.
*H01R 13/6591* (2011.01)
*H01R 13/6585* (2011.01)
(Continued)

(52) U.S. Cl.
CPC ..... *H01R 13/6591* (2013.01); *H01R 12/775* (2013.01); *H01R 13/6585* (2013.01);
(Continued)

(58) Field of Classification Search
CPC ..... H01R 13/6591; H01R 12/775; H01R 13/6585; H01R 13/6598; H01R 12/727; H01R 12/77; H01R 12/777; H01R 12/778
(Continued)

(56) References Cited

U.S. PATENT DOCUMENTS 8,462,502 B2 6/2013 Hirano et al.
8,585,440 B2 11/2013 Jiang et al.
(Continued)

FOREIGN PATENT DOCUMENTS

CN 202585857 U 12/2012
CN 203205638 U 9/2013
(Continued)

OTHER PUBLICATIONS

[No Author Listed], SFF Committee SFF-8639 Specification for Multifunction 6X Unshielded Connector. Rev 2.1. SNIA SFF TWG Technology Affiliate. May 26, 2017. 26 pages.
(Continued)

*Primary Examiner* — Abdullah A Riyami
*Assistant Examiner* — Justin M Kratt
(74) *Attorney, Agent, or Firm* — Wolf, Greenfield & Sacks, P.C.

(57) ABSTRACT

A Peripheral Component Interconnect Express/Serial Attached SCSI (PSAS) female connector includes a frame member, a terminal member, and a cover member; the frame member including a terminal groove disposed in the frame member and a tilt portion disposed in the terminal groove adjacent to a plug end; the terminal member inserted in the frame member and including a Serial Advanced Technology Attachment (SATA) 7 pin terminal, a Serial Attached SCSI (SAS) 40 pin terminal, a 15 Pin signal terminal, a 6 Pin terminal, and a 4 Pin terminal. When the PSAS female connector is engaged with the male connector, the SATA 7 Pin terminal and the SAS 40 Pin terminal are pressed by a terminal of the male connector to be bent toward an outer lateral side of the terminal groove to contact the elastic plate of the cover member. The present invention effectively improves the cross interference during high speed transmis-
(Continued)

sion, thereby achieving the Generation 5 performance requirement.

4 Claims, 2 Drawing Sheets

(51) Int. Cl.
*H01R 13/6598* (2011.01)
*H01R 12/77* (2011.01)
*H01R 12/72* (2011.01)

(52) U.S. Cl.
CPC ..... *H01R 13/6598* (2013.01); *H01R 12/727* (2013.01); *H01R 12/77* (2013.01); *H01R 12/777* (2013.01); *H01R 12/778* (2013.01)

(58) Field of Classification Search
USPC ..... 439/607.55
See application file for complete search history.

(56) References Cited

U.S. PATENT DOCUMENTS

| | | | | |
|---|---|---|---|---|
| 8,702,451 | B2 * | 4/2014 | Luo | H01R 12/725 439/637 |
| 9,225,090 | B2 | 12/2015 | Chen | |
| 9,407,022 | B1 | 8/2016 | Wang | |
| 9,564,714 | B1 | 2/2017 | Wang et al. | |
| 9,941,641 | B1 | 4/2018 | Jiang et al. | |
| 9,985,391 | B1 | 5/2018 | Wang | |
| 10,411,376 | B1 | 9/2019 | Wang et al. | |
| 10,651,589 | B1 | 5/2020 | Wang et al. | |
| 11,251,554 | B1 | 2/2022 | Tan et al. | |
| 2019/0214753 | A1 | 7/2019 | Jiang et al. | |
| 2020/0028289 | A1 | 1/2020 | Dai et al. | |
| 2021/0399455 | A1 | 12/2021 | Wang et al. | |

FOREIGN PATENT DOCUMENTS

| | | | |
|---|---|---|---|
| CN | 203850501 | U | 9/2014 |
| CN | 104283080 | A | 1/2015 |
| CN | 204376132 | U | 6/2015 |
| CN | 205016785 | U | 2/2016 |
| CN | 103887641 | B | 6/2016 |
| CN | 205944534 | U | 2/2017 |
| CN | 206962152 | U | 2/2018 |
| CN | 207116835 | U | 3/2018 |
| CN | 207517943 | U | 6/2018 |
| CN | 109004437 | A | 12/2018 |
| CN | 208284706 | U | 12/2018 |
| CN | 208433570 | U | 1/2019 |
| CN | 209675519 | U | 11/2019 |
| CN | 212380677 | U | 1/2021 |
| TW | 1505580 | B | 10/2015 |
| TW | 1509921 | B | 11/2015 |
| TW | M546036 | U | 7/2017 |
| TW | M563682 | U | 7/2018 |
| TW | M573906 | U | 2/2019 |
| TW | M584561 | U | 10/2019 |
| TW | M606366 | U | 1/2021 |
| TW | M618868 | U | 11/2021 |

OTHER PUBLICATIONS

[No Author Listed], SFF-TA-1001 Specification for Universal x4 Link Definition for SFF-8639. Rev 1.1. SNIA Advance storage & information technology. May 28, 2018. 20 pages.

Mason et al., SAS Standards and Technology Update. Storage Developer Conference (SDC). 2011. 46 pages. URL:https://www.snia.org/sites/default/orig/SDC2011/presentations/monday/HarryMason_SAS%20_Standards_Technology_Updater1.pdf [last accessed Jun. 2, 2022].

Tan et al., PSAS 5.0 Female Connector, U.S. Appl. No. 17/307,276, filed May 4, 2021.

Wang et al., PCIE/SAS Connector Structure, U.S. Appl. No. 17/476,002, filed Sep. 15, 2021.

* cited by examiner

PCIE/SAS FEMALE ELECTRICAL CONNECTOR

BACKGROUND OF THE INVENTION

1. Field of the Invention

The present invention relates to filed of connectors, and more particularly, to a Peripheral Component Interconnect Express/Serial Attached SCSI (PSAS) female connector.

2. Description of the Related Art

In the server storage industry, as the data storage requirement increases continuously, the transmission rate requirement accordingly increases as well. With the increasing of clock rate and the dramatic time shortening of the increasing of clock rate, the transmission rate requirement upon the connector becomes higher than before. Due to a relatively complicated structure, the signal terminal of the PSAS female connector comprises two bending arrangements, wherein the routes of the inner and outer row thereof are longer and closer to each other. Therefore, it is desired to resolve the cross interference under a high data transmission rate, so as to realize a 32 Gbps transmission rate under the U.2 and U. 3 applications.

SUMMARY OF THE INVENTION

For resolving the issues above, a PSAS female connector is disclosed. With a structural improvement, the cross interference issues in the high speed data transmission of the female connector is avoided.

For achieving the aforementioned objectives, a PSAS female connector is provided, comprising a frame member, a terminal member, and a cover member; the frame member comprising a terminal groove and a tilt portion; the terminal groove disposed in the frame member; the tilt portion disposed in the terminal groove adjacent to a plug end; the terminal member inserted in the frame member and comprising a Serial Advanced Technology Attachment (SATA) 7 pin terminal, a Serial Attached SCSI (SAS) 40 pin terminal, a 15 Pin signal terminal, a 6 Pin terminal, and a 4 Pin terminal; the cover member comprising a shorter cover plate and a longer cover plate; the shorter cover plate and the longer cover plate comprising an elastic plate disposed on an end portion of the shorter cover plate and the longer cover plate; the cover member formed in a plate shape, the shorter cover plate and the longer cover plate disposed on a lateral side of the frame member inserted with the SATA 7 Pin terminal and a lateral side of the frame member inserted with the SAS 40 Pin terminal, respectively; before the PSAS female connector being engaged with a male connector, a pin of the SATA 7 Pin terminal and a pin of the SAS 40 Pin terminal abutting against the tilt portion, a contact point of the pin of the SATA 7 Pin terminal and the tilt portion being positioned on a same plane with a contact point of the pin of the SAS 40 Pin terminal and the tilt portion; when the PSAS female connector is engaged with the male connector, the SATA 7 Pin terminal and the SAS 40 Pin terminal are pressed by a terminal of the male connector to be bent toward an outer lateral side of the terminal groove to contact the elastic plate of the cover member; through a contact with the elastic plate of the cover member, the pin of the SATA 7 Pin terminal are connected with the pin of the SAS 40 Pin terminal.

Preferably, the frame member of the PSAS female connector is formed of a plastic material.

Preferably, the frame member of the PSAS female connector comprises a conductive plastic; the conductive plastic comprises a shorter conductive plastic portion and a longer conductive plastic portion both disposed in the terminal groove; the shorter cover plate and the longer cover plate are connected with the shorter conductive plastic portion and longer conductive plastic portion, respectively.

The PSAS female connector comprises a positioner; the frame member comprises a position hole formed on two sides of the frame member; an end of the positioner passes through the position hole to be fixed on a PCB. With such configuration, the present invention achieves the following advantages.

Compared with prior arts, the two cover plates in the present invention have an elastic plate on the end portion thereof, and the elastic plates are attached to the frame member corresponding to the insertion positions of the SATA7 Pin and SAS 40 Pin signal power source terminals, respectively. The pins of the SATA 7 Pin terminal and SAS 40 Pin terminal abut against the tilt portion, wherein the contact point of the pin of the SATA 7 Pin terminal and the tilt portion are positioned on a same plane with the contact point of the pin of the SAS 40 Pin terminal and the tilt portion, so as to prevent the pins from being positioned at different heights. During operation, after the PSAS female connector is engaged with the male connector, the SATA 7 Pin terminal and the SAS 40 Pin terminal are pressed by the terminal of the male connector to be bent toward an outer lateral side of the terminal groove to contact the elastic plate of the cover member. Through contact with the elastic plate of the cover member, the pin of the SATA 7 Pin terminal is connected with the pin of the SAS 40 Pin terminal. The cover member contacted with the conductive plastic, facilitating the connection between the head end and the tail end of the grounding terminal, thereby providing an optimal cover and improving the cross interference, achieving a Generation 5 (Gen5) performance requirement.

DETAILED DESCRIPTION OF THE INVENTION

Figure 1:
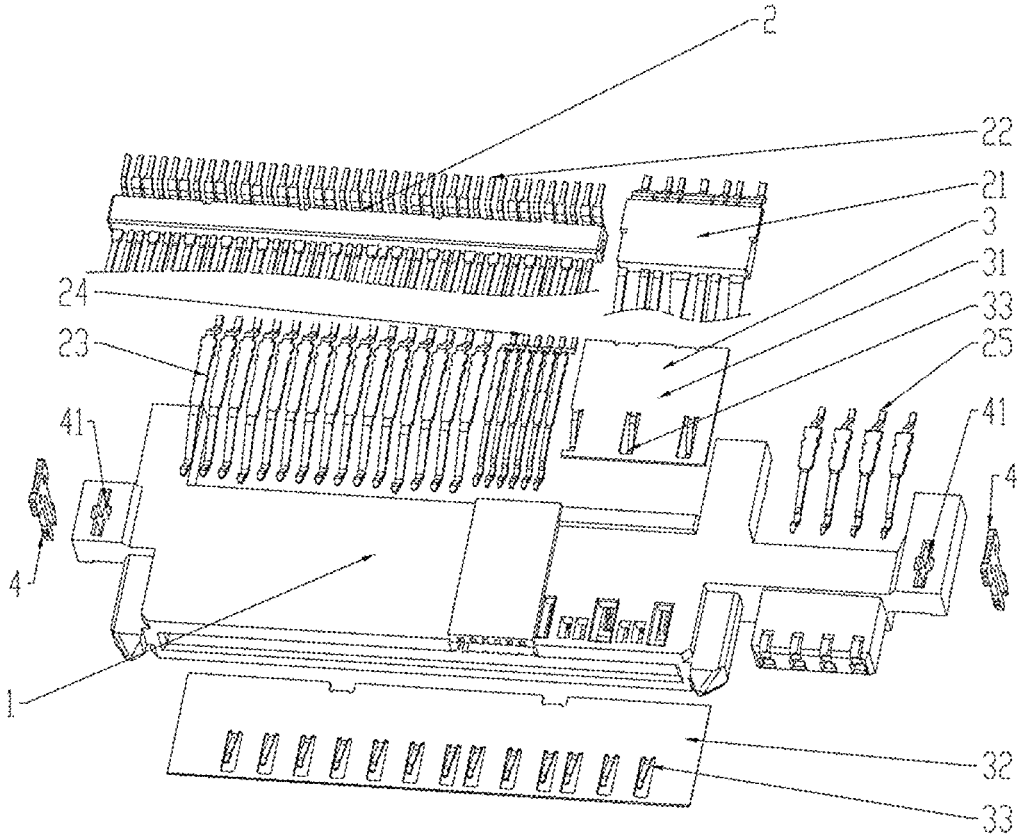
FIG. 1 is an exploded view of the PSAS female connector in accordance with an embodiment of the present invention.
Figure 2:
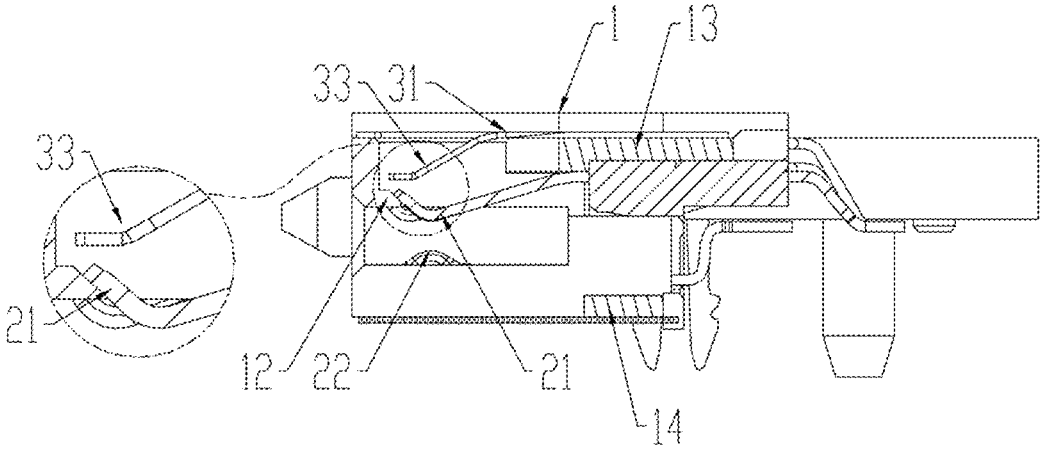
FIG. 2 is a partially enlarged sectional side view of the PSAS female connector, illustrating the terminal pin abutting against the tilt portion before engagement.
Figure 3:
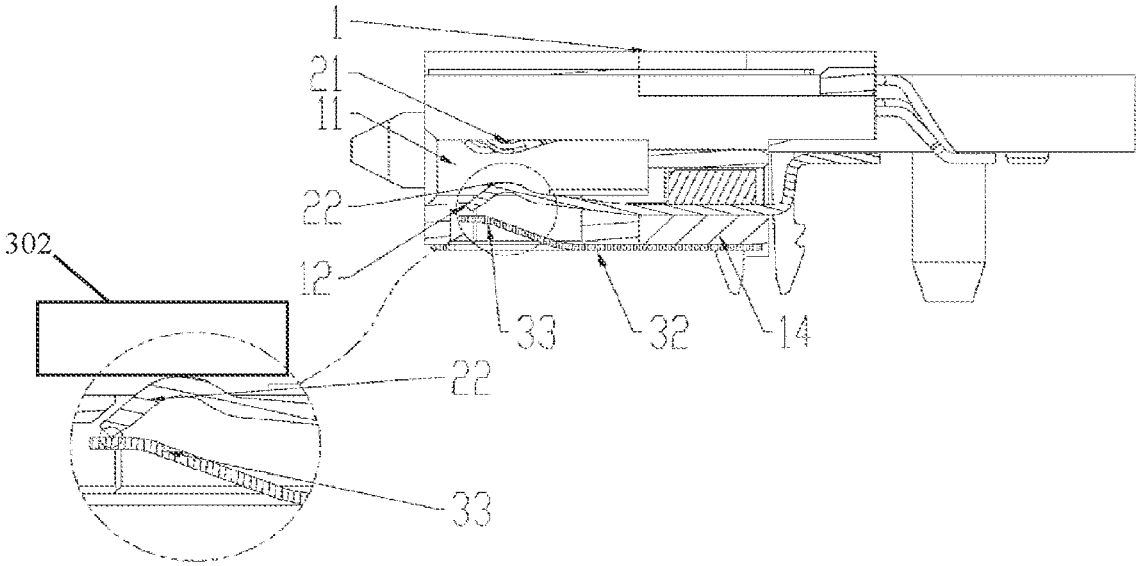
FIG. 3 is a partially enlarged sectional side view of the PSAS female connector, illustrating the terminal pin contacting the elastic plate.

The aforementioned and further advantages and features of the present invention will be understood by reference to the description of the preferred embodiment in conjunction with the accompanying FIG. 1 to FIG. 3 where the components are illustrated based on a proportion for explanation but not subject to the actual component proportion.

Embodiment 1

Referring to FIG. 1, the PSAS female connector comprises a frame member 1, a terminal member 2, and a cover member 3.

The frame member 1 comprises a terminal groove 11 and a tilt portion 12.

The terminal groove 11 is disposed in the frame member 1.

The tilt portion 12 is disposed in the terminal groove 11 adjacent to a plug end. As shown in FIGS. 2 and 3, the tilt portion 12 is shaped as a shelf.

The terminal member 2 is inserted in the frame member 1 and comprises a SATA 7 Pin terminal 21, an SAS 40 Pin terminal 22, a 15 Pin signal terminal 23, a 6 Pin terminal 24, and a 4 Pin terminal 25.

The cover member 3 comprises a shorter cover plate 31 and a longer cover plate 32. As shown in FIG. 1, the shorter cover plate 31 is shorter than the longer cover plate 32. Both the shorter cover plate 31 and the longer cover plate 32 comprises an elastic plate 33 disposed on an end portion of the shorter cover plate 31 and the longer cover plate 32. As shown in FIG. 1, the elastic plate 33 of the shorter cover plate 31 includes a first plurality of contact members; and the elastic plate 33 of the longer cover plate 32 includes a second plurality of contact members.

The cover member 3 is formed in a plate shape. The shorter cover plate 31 and the longer cover plate 32 are disposed on a lateral side of the frame member 1 inserted with the SATA 7 Pin terminal 21 and a lateral side of the frame member 1 inserted with the SAS 40 Pin terminal 22, respectively.

Referring to FIG. 2 and FIG. 3, before the PSAS female connector being engaged with a male connector 302, a pin of the SATA 7 Pin terminal 21 and a pin of the SAS 40 Pin terminal 22 abut against the tilt portion 12, wherein a contact point of the pin of the SATA 7 Pin terminal 21 and the tilt portion are positioned on a same plane with a contact point of the pin of the SAS 40 Pin terminal 22 and the tilt portion, thereby preventing the pins from being positioned at different heights. When the PSAS female connector is engaged with the male connector 302, the SATA 7 Pin terminal 21 and the SAS 40 Pin terminal 22 are pressed by a terminal of the male connector to be bent toward an outer lateral side of the terminal groove 11 to contact the elastic plate 33 of the cover member 3. Through the contact with the elastic plate 33 of the cover member 3, the pin of the SATA 7 Pin terminal 21 is connected with the 10 pin of the SAS 40 Pin terminal 22, thereby forming an optimal cover and improving the cross interference, achieving the Gen5 performance requirement.

Embodiment 2

Referring to FIG. 1 to FIG. 3, on the basis of embodiment 1, the frame member of the PSAS female connector is formed of a plastic material. The frame member 1 comprises a conductive plastic. The conductive plastic comprises a shorter conductive plastic portion 13 and a longer conductive plastic portion 14 that are disposed in the terminal groove 11. The shorter cover plate 31 and the longer cover plate 32 are connected with the shorter conductive plastic portion 13 and the longer conductive plastic portion 14, respectively.

The PSAS female connector comprises a positioner 4. The frame member comprises a position hole 41 formed on two sides of the frame member 1. An end of the positioner 4 passes through the position hole 41 to be fixed on a PCB.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A Peripheral Component Interconnect Express/Serial Attached SCSI (PSAS) female connector, comprising:

a frame member comprising a terminal groove disposed in the frame member and a shelf disposed in the terminal groove adjacent to a plug end;

a terminal member inserted in the frame member and comprising a SATA 7 Pin terminal, a SAS 40 Pin terminal, a 15 Pin signal terminal, a 6 Pin terminal, and a 4 Pin terminal; and a metal cover member comprising a shorter cover plate and a longer cover plate; the shorter cover plate comprising a first plurality of contact members disposed on an end portion of the shorter cover plate and the longer cover plate comprising a second plurality of contact members disposed on an end portion of the longer cover plate, wherein:

the shorter cover plate and the longer cover plate are disposed on a lateral side of the frame member inserted with the SATA 7 Pin terminal and a lateral side of the frame member inserted with the SAS 40 Pin terminal, respectively;

when the PSAS female connector is dis-engaged with a male connector, a pin of the SATA 7 Pin terminal and a pin of the SAS 40 Pin terminal abut the shelf; and when the PSAS female connector is engaged with the male connector, the SATA 7 Pin terminal and the SAS 40 Pin terminal are pressed by a respective terminal of the male connector to be bent toward a respective lateral side of the terminal groove to contact the first plurality of contact members and second plurality of contact members of the cover member, respectively.

2. The PSAS female connector of claim 1, wherein the frame member of the PSAS female connector is formed of a plastic material.

3. The PSAS female connector of claim 1, wherein the frame member comprises a conductive plastic; the conductive plastic comprises a shorter conductive plastic portion and a longer conductive plastic portion that are disposed in the terminal groove; and the shorter cover plate and the longer cover plate are connected with the shorter conductive plastic portion and the longer conductive plastic portion, respectively.

4. The PSAS female connector of claim 1, wherein the PSAS female connector comprises a positioner; the frame member comprises a position hole formed on two sides of the frame member; and an end of the positioner passes through the position hole to be fixed on a PCB.

* * * * *